US005183336A

United States Patent [19]

Poltorak et al.

[11] Patent Number: 5,183,336

[45] Date of Patent: Feb. 2, 1993

[54] STIRRING ASSEMBLY

[75] Inventors: Jeffrey P. Poltorak; Omar A. Swift, both of Vineland, N.J.

[73] Assignee: Kontes Glass Company, Vineland, N.J.

[21] Appl. No.: 822,869

[22] Filed: Jan. 21, 1992

[51] Int. Cl.[5] ..... B01F 13/08

[52] U.S. Cl. ..... 366/273; 366/308

[58] Field of Search ..... 366/273, 274, 308, 326, 366/342, 343, 344; 416/3, 142

[56] References Cited

U.S. PATENT DOCUMENTS

| | | | |
|---|---|---|---|
| 385,151 | 6/1888 | Thompson | 366/308 |
| 866,369 | 9/1907 | Learnard | 416/142 A |
| 3,207,489 | 9/1965 | Berman | 366/308 |
| 3,622,129 | 11/1971 | Mazowski | 366/274 |
| 4,207,028 | 6/1980 | Ridder | 416/142 A |
| 4,355,906 | 10/1982 | Ono | 366/308 |
| 4,872,764 | 10/1989 | McClean | 366/308 |

FOREIGN PATENT DOCUMENTS

| | | | |
|---|---|---|---|
| 2388502 | 12/1978 | France | 366/308 |
| 2131311 | 6/1984 | United Kingdom | 366/343 |

*Primary Examiner*—Philip R. Coe
*Assistant Examiner*—Randall Edward Chin
*Attorney, Agent, or Firm*—James & Franklin

[57] ABSTRACT

For use with large size containers having narrow entrance openings, the stirrer blade is mounted on a support rod for pivotal movement from an angled position which permits insertion into the narrow entrance opening to a perpendicular position suitable for stirring. The blade is carried on a slotted tube which has a recess into which a plunger connected to the end of the rod is movably received. The plunger contacts the upper edge of the blade. Once the blade is situated in the container, the rod is moved relative to the tube, causing the plunger to pivot the blade to the stirring position.

9 Claims, 3 Drawing Sheets

STIRRING ASSEMBLY

The present invention relates to stirrers designed for use in large size containers such as bottles or flasks having relatively narrow entrance openings and more particularly to a stirrer assembly with a blade which can be positioned to permit insertion into a large size bioreactor with a narrow entrance opening and thereafter reoriented into a stirring position from the exterior of the bioreactor.

Many laboratory and industrial fluids require long term controlled stirring while situated in a container such as a bottle, flask or the like. Mechanical stirrers of various types are known to perform this function.

The growth of anchorage dependent cells on microcarriers within specialized vessels known as bioreactors, in particular, requires long term, precisely controlled gentle stirring. In order to accomplish this stirring mechanically, it is known to use a magnetic apparatus which includes a magnetic stirrer assembly. The assembly includes a support rod with an attached magnetic stirrer blade. The support rod is retained by a cap which screws over the externally threaded neck of the container. The bioreactor, with the magnetic stirrer, is placed on an apparatus which generates a changing magnetic field. As the generated magnetic field changes in a controlled manner, the magnetic stirrer slowly rotates, gently stirring the fluid to keep the microcarriers in suspension as the culture is grown.

Bioreactors of this type are commercially available in sizes from 100 ml to 8 liter. They have externally threaded necks with entrance openings of from 70 mm to 100 mm. Such entrance openings are sufficiently wide to permit a blade, mounted perpendicular to the support rod to pass through the entrance opening without unduly restricting the dimensions of the blade. However, in larger size bioreactors, such as 15 or 36 liter sizes, a blade with sufficient width to perform the stirring function efficiently cannot be inserted through a standard size entrance opening which is defined by a neck threaded to receive a conventional size screw cap.

Magnetic stirrer assemblies which can fit through narrow entrance openings are commercially available. These assemblies include blades divided into two separate parts. The parts are each pivotally mounted to the support rod for independent movement with respect to each other. A ring lock is provided to lock the parts into position. However, there is no provision for a mechanism which permits the blade to be reoriented and locked from the outside of the vessel. This must be done manually by reaching into the vessel through the entrance opening, reorienting the blade parts to the proper position and locking the parts.

The present invention overcomes this problem by providing a mechanical linkage which can be manipulated from the exterior of the bioreactor to reorient and lock the blade into the stirring position. It is designed for use with larger size magnetically stirred bioreactors with narrow entrance openings. The magnetic stirrer assembly includes a unitary blade which can be reoriented from a position which permits insertion into the entrance opening and locked into the stirring position, after it has been fully inserted into the bioreactor. The position of the blade is controlled from the outside of the bioreactor by the mechanical linkage.

It is, therefore, a prime object of the present invention to provide a stirrer assembly with a unitary position adjustable blade.

It is another object of the present invention to provide a stirrer assembly with a blade the position of which can be controlled remotely from outside of the container into which the blade is inserted.

It is another object of the present invention to provide a stirrer assembly designed for use as a magnetic stirrer assembly in a large size bioreactor with a narrow entrance opening.

In accordance with the present invention, a stirrer assembly is provided for use in a large size container having an entrance with a diameter smaller than the blade. The assembly includes a rod and plunger means operably connected to one end of the rod. Tubular support means are provided and define a recess into which the plunger means is received for movement between first and second positions as the rod is moved between extended and retracted positions. The support means include first and second spaced elements. A blade is provided. Means are provided for mounting the blade for pivotal movement relative to the elements of the support means. The blade has an edge. The plunger means abuts the blade edge and is effective to pivot the blade from a position in which the blade can pass through the container entrance toward a position suitable for stirring, as the plunger means is moved toward its second position by of the rod.

The blade is preferably free to be pivoted away from the stirring position when the plunger means are moved toward the first position.

The support means recess preferably defines a cylindrical chamber into which the plunger means is movably received. The elements have arcuate cross-sectional configurations. The plunger means defines an internal recess into which the enlarged end of the rod is movably received.

Magnetic means are affixed to the blade. The container is preferably a bioreactor. The stirring position is preferably substantially perpendicular to the rod.

To these and such other objects which may hereinafter appear, the present invention relates to a stirrer assembly with a pivotal blade which permits insertion into large size containers with relatively narrow entrance openings, as set forth in the following specification and recited in the annexed claims, taken together with the accompanying drawings in which like numerals refer to like parts and in which:

Figure 1:
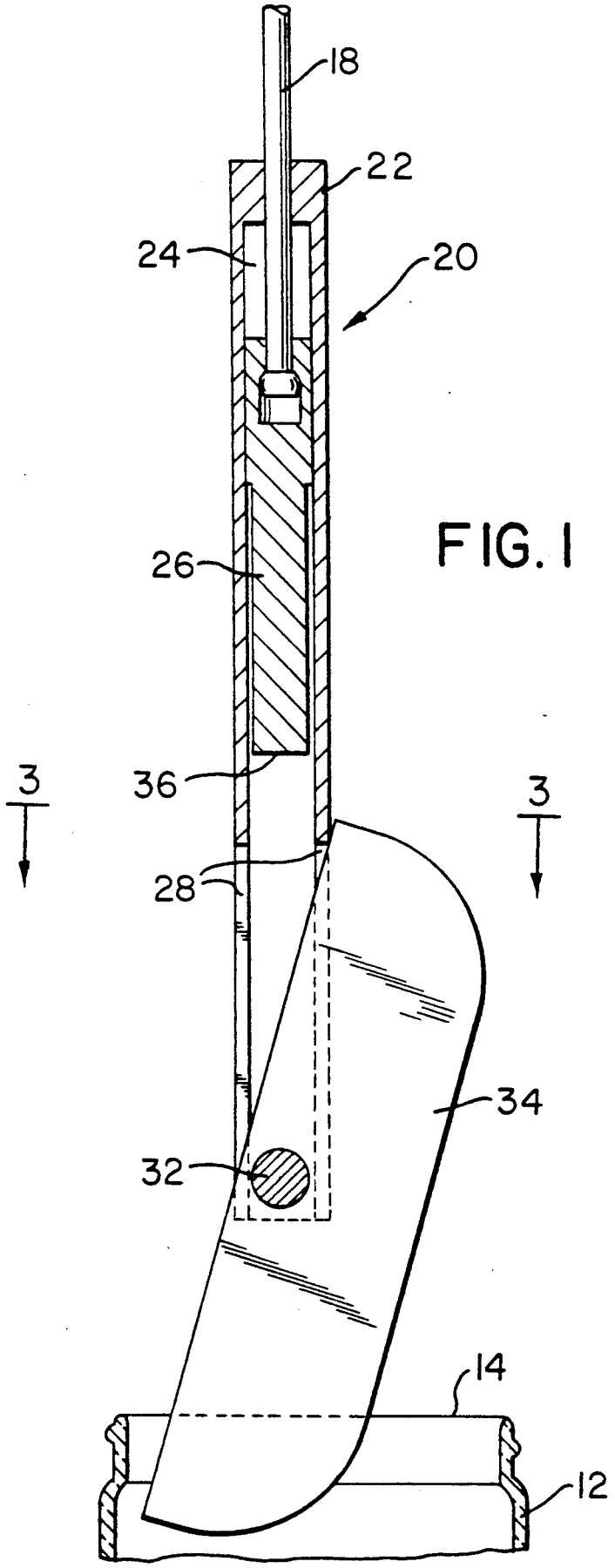
FIG. 1 is a side cross-sectional view of the stirrer assembly as it is being inserted into a bioreactor.

As shown in the drawings, the stirrer assembly of the present invention is designed for use with a container, such as bioreactor 10. In particular, the present invention is designed for use with a large size bioreactor having an externally threaded neck 12 defining an entrance opening 14 with a diameter which is smaller than the width of the impeller or blade 16.

In addition to a unitary blade 16, the stirrer assembly includes a support rod 18, and a tubular support member, generally designated 20. Member 20 has a top 22 with an opening through which rod 18 extends. A cylindrical chamber 24 is defined within member 20. A plunger 26, connected to the end of rod 18, is movably received within chamber 24.

The lower portion of member 20 is slotted, creating spaced elements 28, 30, each of which has an arcuate cross-section. Blade 16 is mounted between elements 28 and 30 so as to freely pivot within the slot defined between those elements. A magnet 32 is mounted on member 20. Preferably, magnet 32 is fixedly received in openings in elements 28, 30 and extends across the slot. Magnet 32 is preferably cylindrical in configuration and functions as a pivot point for blade 16. Blade 16 has an opening into which the magnet is received.

Blade 16 has an upper edge 34 which is abutted by the bottom surface 36 of plunger 26. The position of rod 18 and hence plunger 26 determines the position of blade 16. Prior to insertion into bioreactor 10, rod 16 is moved to its extended position with plunger 26 towards the top of chamber 24 of member 20, permitting blade 16 to pivot within the slot between elements 28, 30 to an insertion position, as shown in FIG. 1.

Figure 2:
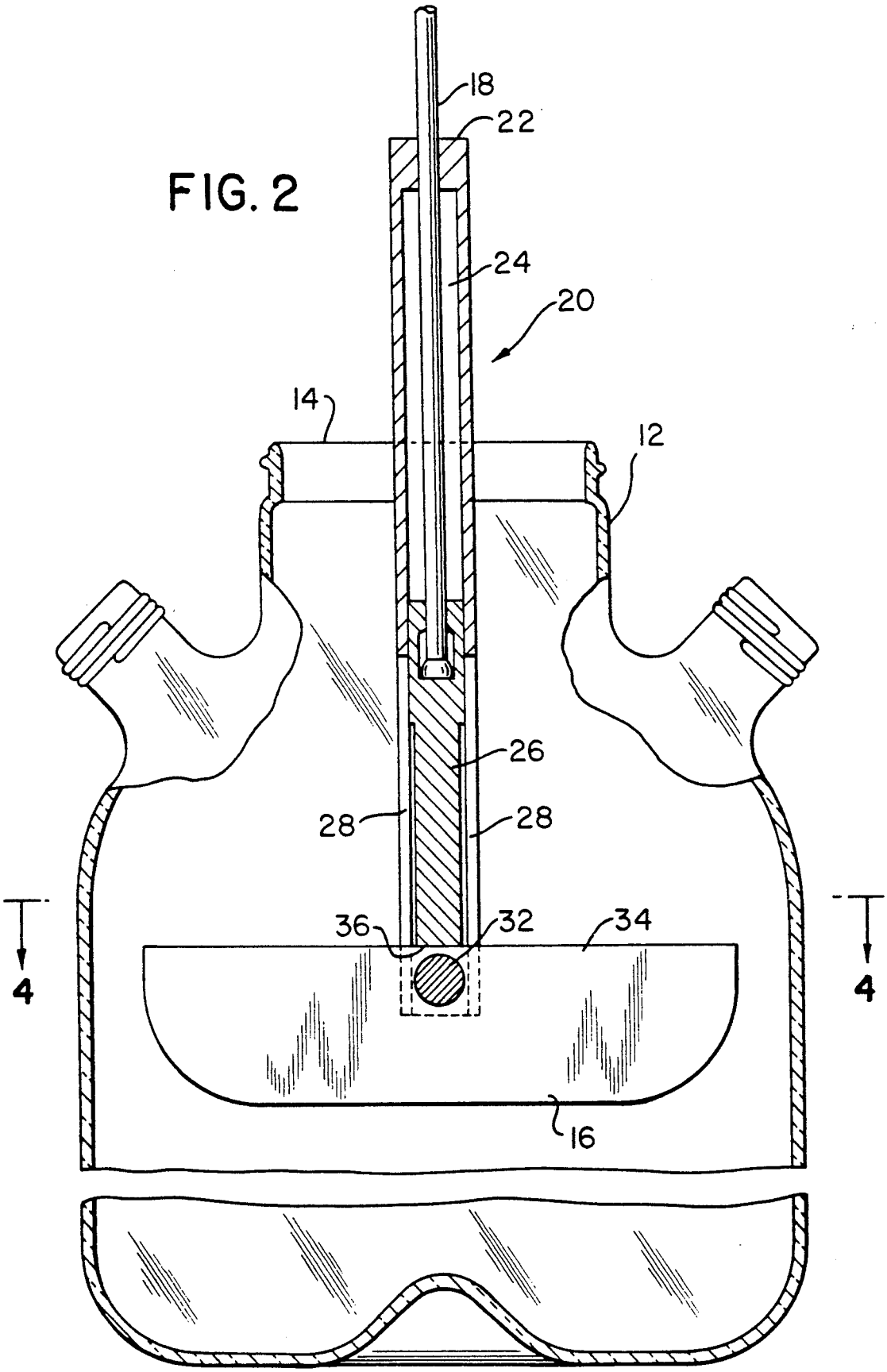
FIG. 2 is a side cross-sectional view of the stirrer assembly in the stirring position.
Figure 3:
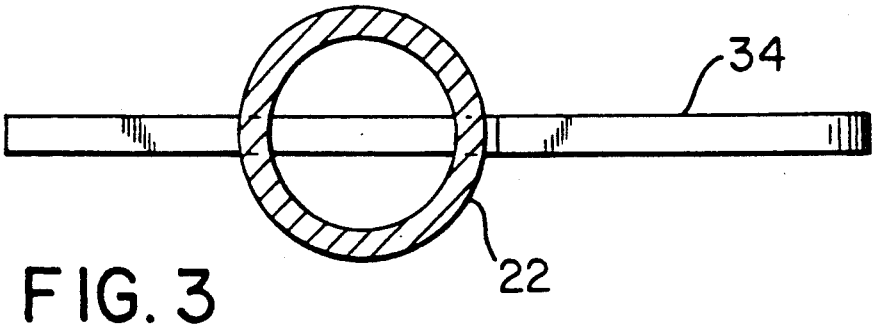
FIG. 3 is a cross-sectional view taken along lines 3—3 of FIG. 1.
Figure 4:
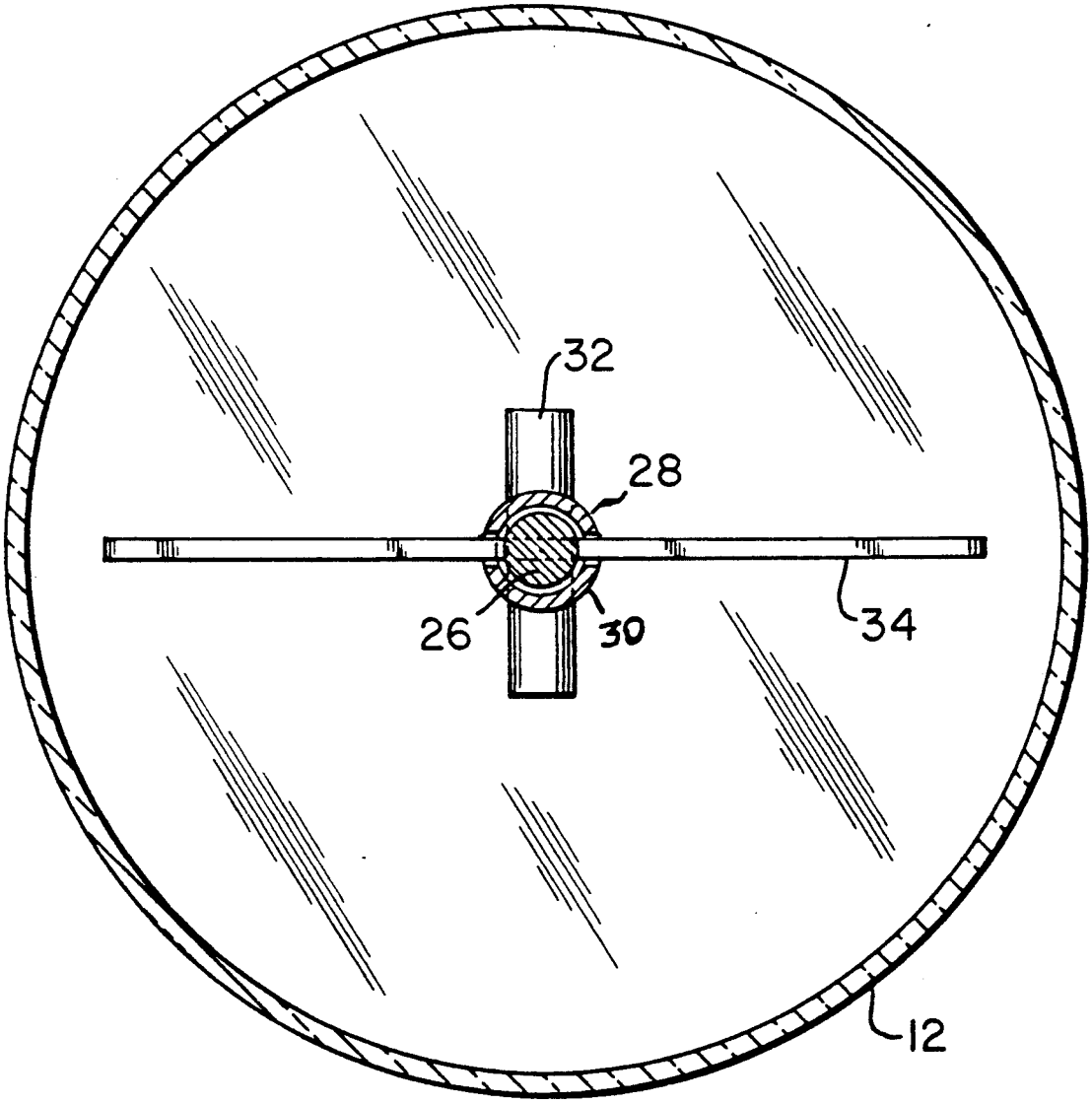
FIG. 4 is a cross-sectional view taken along lines 4—4 of FIG. 2.

The blade is then inserted into entrance opening 14 and with member 20 held stationary, rod 18 is moved relative to member 20 to a retracted position, moving plunger 26 down chamber 24 in member 20. The bottom surface 36 of plunger 26 acts on blade edge 34 causing the blade to pivot to the stirring position, shown in FIG. 2, substantially perpendicular to rod 18. The blade will remain locked in that position until the rod is moved back to the extended position.

To remove the assembly, the rod is moved relative to member 20 to the extended position, such that plunger 26 is remote from blade 16. Member 20 is manipulated such that the blade contacts the interior side wall of the bioreactor and is pivoted to the position shown in FIG. 1, to permit withdrawal from the vessel.

It will now be appreciated that the present invention relates to a stirrer assembly with a pivotable blade the position of which is controlled from the exterior of the container into which it is inserted. This permits the blade to be positioned and inserted into an entrance opening with a diameter smaller than the width of the blade and thereafter repositioned and locked for effective stirring.

While only a single preferred embodiment of the present invention has been disclosed for purposes of illustration, it is obvious that many variations and modifications could be made thereto. It is intended to cover all of these variations and modifications which fall within the scope of the present invention as defined by the following claims:

We claim:

1. A stirrer assembly for use in a container or the like having an entrance opening, said assembly comprising a rod, plunger means operably connected to one end of said rod, support means comprising a tubular portion defining a recess into which said plunger means is received for movement between first and second positions as said rod is moved relative to said support means between an extended position and a retracted position, first and second spaced elements extending from said tubular portion, a unitary blade, means for mounting said blade between said elements for pivotal movement relative to said support means, said blade having an edge, said plunger means cooperating with said blade edge and being effective to move said blade from a position in which said blade can pass through the container entrance toward a position suitable for stirring, as said plunger means is moved toward said second position.

2. The assembly of claim 1 wherein said blade is free to be pivoted away from said position suitable for stirring when said plunger means is moved toward said first position.

3. The assembly of claim 1 wherein said elements have arcuate cross-sectional configurations.

4. The assembly of claim 1 wherein the means for mounting comprises a magnet.

5. The assembly of claim 4 wherein said magnet extends between said elements.

6. The assembly of claim 5 wherein said blade is pivotally mounted on said magnet.

7. The assembly of claim 1 wherein the container is a bioreactor.

8. The assembly of claim 1 wherein said position suitable for stirring is substantially perpendicular to said rod.

9. The assembly of claim 1 wherein said tubular support means recess comprises a substantially cylindrical chamber.

* * * * *